US008499917B2

(12) United States Patent
Smith

(10) Patent No.: US 8,499,917 B2
(45) Date of Patent: Aug. 6, 2013

(54) FOREIGN OBJECT DETECTOR

(75) Inventor: Peter Ronald Smith, Essendon (AU)

(73) Assignee: Astrosys International Ltd, Kowloon (HK)

( * ) Notice: Subject to any disclaimer, the term of this patent is extended or adjusted under 35 U.S.C. 154(b) by 1323 days.

(21) Appl. No.: 11/361,879

(22) Filed: Feb. 24, 2006

(65) Prior Publication Data

US 2006/0209589 A1 Sep. 21, 2006

(30) Foreign Application Priority Data

Feb. 25, 2005 (AU) ..... 2005900897

(51) Int. Cl.
*G07D 7/00* (2006.01)
*G07G 3/00* (2006.01)

(52) U.S. Cl.
USPC ..... 194/202; 194/203

(58) Field of Classification Search
USPC ..... 194/349, 351, 202, 203
See application file for complete search history.

(56) References Cited

U.S. PATENT DOCUMENTS

| | | | | |
|---|---|---|---|---|
| 3,159,277 | A | 12/1964 | Carlson | |
| 4,513,439 | A * | 4/1985 | Gorgone et al. | 382/135 |
| 5,242,041 | A * | 9/1993 | Isobe | 194/207 |
| 5,259,490 | A * | 11/1993 | Gardellini | 194/203 |
| 5,325,952 | A * | 7/1994 | McGinley et al. | 194/203 |
| 5,721,420 | A * | 2/1998 | May | 235/379 |
| 5,806,649 | A | 9/1998 | Walsh | |
| 5,887,695 | A * | 3/1999 | Hatamachi et al. | 194/207 |
| 5,988,345 | A * | 11/1999 | Bergeron et al. | 194/203 |
| 5,996,888 | A * | 12/1999 | Gromatzky | 232/15 |
| 6,179,110 | B1 | 1/2001 | Ohkawa et al. | |
| 6,304,178 | B1 * | 10/2001 | Hayashida | 340/545.1 |
| 6,364,087 | B1 * | 4/2002 | Abraham | 194/203 |
| 6,648,221 | B2 * | 11/2003 | Thawley et al. | 235/379 |
| 6,724,324 | B1 * | 4/2004 | Lambert | 341/33 |
| 7,185,740 | B2 * | 3/2007 | Beskitt et al. | 186/37 |
| 2004/0211644 | A1 * | 10/2004 | Liu et al. | 194/207 |
| 2004/0221349 | A1 * | 11/2004 | Beskitt et al. | 902/9 |
| 2006/0086895 | A1 * | 4/2006 | Fitzgibbon et al. | 250/221 |

FOREIGN PATENT DOCUMENTS

| | | |
|---|---|---|
| GB | 2 390 727 | 1/2004 |
| GB | 2 401 707 | 11/2004 |
| WO | WO 94/14141 | 6/1994 |

* cited by examiner

*Primary Examiner* — Jeffrey Shapiro
(74) *Attorney, Agent, or Firm* — Merchant & Gould P.C.

(57) ABSTRACT

A foreign object detector for a note validator, the detector includes means defining a note path and gate means in the note path operable between an open position for allowing a note to pass the gate means and a fully closed position for preventing a note from passing the gate means. The gate means is biased towards the fully closed position. The foreign object detector also includes sensing means for detecting when the gate means is in the fully closed position. In the fully closed position, a leading edge of the gate means extends outside the note path and is received within a recess in the means defining the note path, whereby a foreign object in the note path obstructing the recess prevents the gate means from reaching the fully closed position, the sensing means thereby detecting the presence of the foreign object in the note path.

41 Claims, 5 Drawing Sheets

FOREIGN OBJECT DETECTOR

FIELD OF THE INVENTION

This invention relates generally to the identification and validation of currency notes and more particularly to a detector for determining the presence of foreign objects such as retrieving strings or the like, for the purpose of fraud. Although the invention is of wide application, it is especially applicable to the identification and validation of paper currency in change dispensers, pay stations, vending machines and other equipment where payment is made or an operation enabled by insertion of a currency note. Currency notes are also known as banknotes, paper money or bills.

BACKGROUND OF THE INVENTION

The use of currency note validators for the purpose of authenticating currency and providing goods, services or change in return, is well known. Many of these validators include a slot opening for receiving currency notes. The note moves along a note path where it is tested for authenticity. The note is either returned by the reversal of the drive moving the note along the path, or it proceeds to a storage location.

A fraudulent activity is to retrieve a note by attaching a piece of string or tape to the note and pulling the note out, once it has been validated and credit has been given. To assist in pulling the strung note out, an invalid piece of paper may be inserted, with the rejection of the paper reversing the rollers, which makes it easier to pull out the strung note. There have been a number of attempts to counteract such "stringing" activity.

One method has been described in U.S. Pat. No. 6,179,110 assigned to Japan Cash Machine Co, and comprises a rotating slotted drum. The note passes through the slot in the centre of the drum. Once the note has passed, and while it is being validated, the drum rotates. The drum winds any string attached to the note around the drum. This method catches the majority of "strung" notes, however, it renders the machine inoperable until an operator comes to unwind the string from the drum. This results in loss of income and user frustration at an inoperable machine.

U.S. Pat. No. 5,325,952 assigned to Dixle-Jarco, Inc, describes an antiretrieval device for a currency validator. The device includes a punch plate and teeth that define a shear to cut any string or tape attached to a note. If the string or tape is not cut, any attempt to remove the note pulls it across teeth which tear or shred the note. The cutting or tearing of either the string or the note may result in portions of string or note remaining in the machine and affecting its working, thereby putting it out of service.

Another device is described in U.S. Pat. No. 5,988,345 assigned to Mars Incorporated. The validator includes two prisms mounted on opposite sides of a note pathway. A light source is provided for emitting light toward the first prism. The first prism reflects the light across the note pathway toward the second prism, with the light passing from the first to the second prism in a straight line parallel to a plane of the note pathway. A photodetector receives light reflected from the second prism. A foreign object, such as a string obstructs a portion of light reflected from the first to the second prism. This method can be extremely sensitive, and indeed is often too sensitive, as it can be affected by sunlight or torch light, or can be recalibrated by use of clear plastic strips. The extreme sensitivity of this device often results in valid notes being rejected, and frustrated users reporting a defective machine.

The applicant does not concede that the prior art discussed above forms part of the common general knowledge in the art at the priority date.

It is therefore an object of the present invention to provide a foreign object detector for currency validators that at least in part addresses one or more of the above-described problems associated with prior art detectors.

SUMMARY OF THE INVENTION

According to a first aspect of the invention, there is provided a foreign object detector for a note validator, the detector including:

means defining a note path;

gate means in said note path operable between an open position for allowing a note to pass the gate means and a fully closed position for preventing a note from passing the gate means, wherein the gate means is biased towards the fully closed position; and sensing means for detecting when the gate means is in the fully closed position;

wherein, in the fully closed position, a leading edge of the gate means extends outside the note path and is received within a recess in the means defining the note path, whereby a foreign object in the note path obstructing the recess prevents the gate means from reaching the fully closed position, the sensing means thereby detecting the presence of the foreign object in the note path.

Advantageously, the note validator includes an insertion slot at one end of the note path and drive means for moving the note along the note path. Preferably, there is provided control means arranged to open the gate means, drive the note past the gate means and then drive or allow the gate means to move towards its fully closed position, whereby to detect any foreign objects attached to the rear edge of the note. The rear edge of the note may be detected to trigger the closing of the gate means.

Preferably, the note path is generally rectangular and defined by means such as a housing. The gate means may travel from one side of the note path to the opposite side. The periphery of the gate means preferably extends outside the note path and is received within recesses provided in the housing. This provides an overlap that protects the gate means against being forced open. The gate means may be biased towards the fully closed position by a light spring.

Said sensing means may comprise a contact for said gate means that closes an electrical circuit to signal that the gate means is in the fully closed position.

Advantageously, the gate means is associated with an actuator, such as a solenoid, for moving the gate means at least from the fully closed position to the open position. The gate means is preferably connected to the actuator via a right angle drive mechanism. The right angle drive mechanism may include a pair of parallel oblique pin slots, which are engaged by respective pins projecting from the gate means. Said slots may have parallel portions to lock or latch the gate means in the fully closed and/or fully open positions.

Preferably, when viewed from above, the gate means has a zig-zag profile.

According to a second aspect of the invention, there is provided a foreign object detector for a note validator, the detector including:

means defining a note path;

gate means in said note path operable between an open position for allowing a note to pass the gate means and a fully closed position for preventing a note from passing the gate means, wherein the gate means is biased towards the fully closed position; and wherein, in the fully closed position, the periphery of the gate means extends outside the note path and is received within recesses in the means defining the note path, thereby protecting the gate means against being forced open.

According to a third aspect of the invention, there is provided a foreign object detector for a note validator, the detector including:

means defining a note path;

gate means in said note path operable between an open position for allowing a note to pass the gate means and a fully closed position for preventing a note from passing the gate means, wherein the gate means is biased towards the fully closed position;

sensing means for detecting when the gate means is in the fully closed position; and control means responsive to treat the failure of the gate means to reach the fully closed position as an indication that there is a foreign object in the note path.

BRIEF DESCRIPTION OF THE DRAWINGS

The invention will now be described, by way of example only, with reference to the accompanying drawings, in which.

DETAILED DESCRIPTION OF THE EMBODIMENTS

Figure 1:
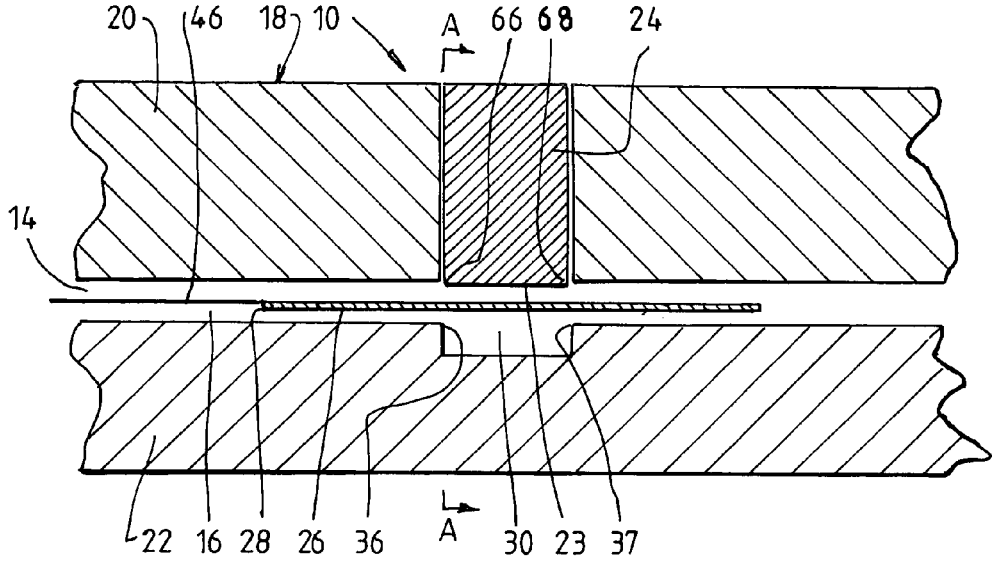
FIG. 1 is a cross-sectional view of a foreign object detector according to a first embodiment of the invention, with the gate means in the open position.
Figure 3:
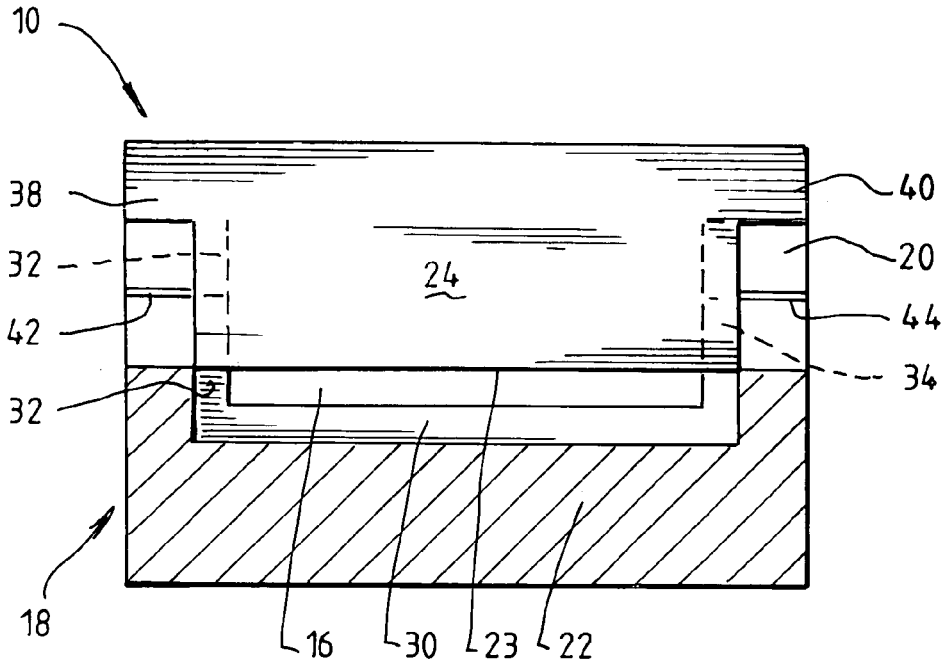
FIG. 3 is a cross-sectional view, through the line A-A of FIG. 1, of the foreign object detector, with the gate means in the open position.
Figure 4:
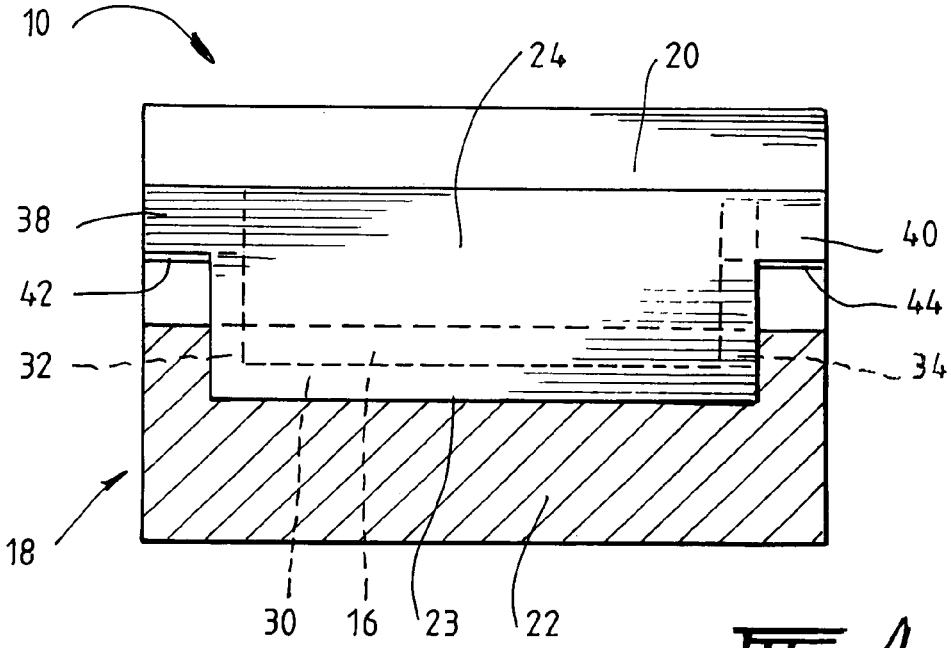
FIG. 4 is a similar view to that of FIG. 3, with the gate means in the fully closed position.
Figure 5:
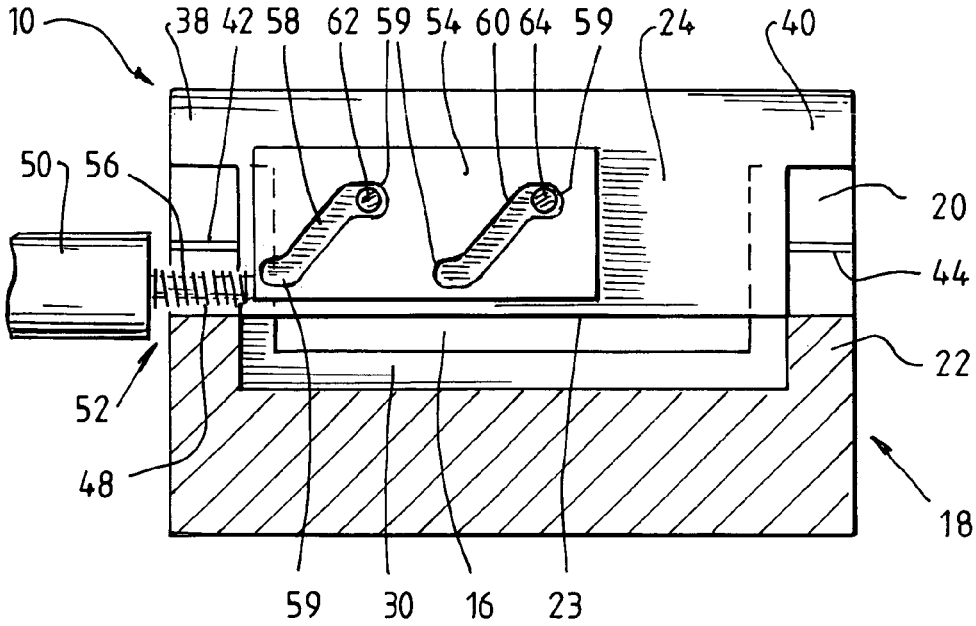
FIG. 5 is a cross-sectional view similar to FIG. 3 depicting a preferred mechanism for opening and closing the gate means.
Figure 6:
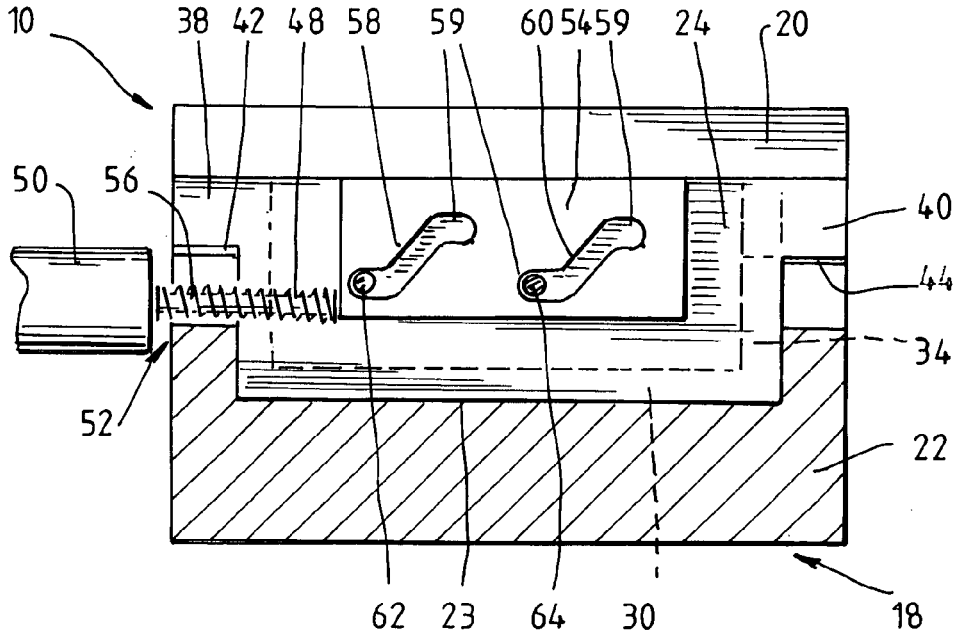
FIG. 6 is a view similar to that of FIG. 5, with the gate means in the fully closed position.

A foreign object detector 10 is shown in the accompanying drawings and is for use with a note validator 12. The note validator 12 will typically include an insertion slot 14 at one end of a note path 16 and drive means (shown in FIG. 7 to 9), such as a series of rollers 17, which moves a note 26 along the note path 16. The note path 16 is defined by means such as a housing 18 having upper and lower parts 20, 22. The foreign object detector 10 includes a gate means 24 in the note path 16 operable between an open position, as shown in FIGS. 1, 3 and 5, and a fully closed position, as shown in FIGS. 4 and 6. The note path 16 is generally rectangular in cross-section and a leading edge 23 of the gate 24 travels from the upper housing 20 to the lower housing 22. It will be appreciated that the gate 24 may travel from lower to upper, or from one side to the other. The gate 24 is biased towards the fully closed position for preventing the note 26, or any other object, from passing the gate 24.

Figure 2:
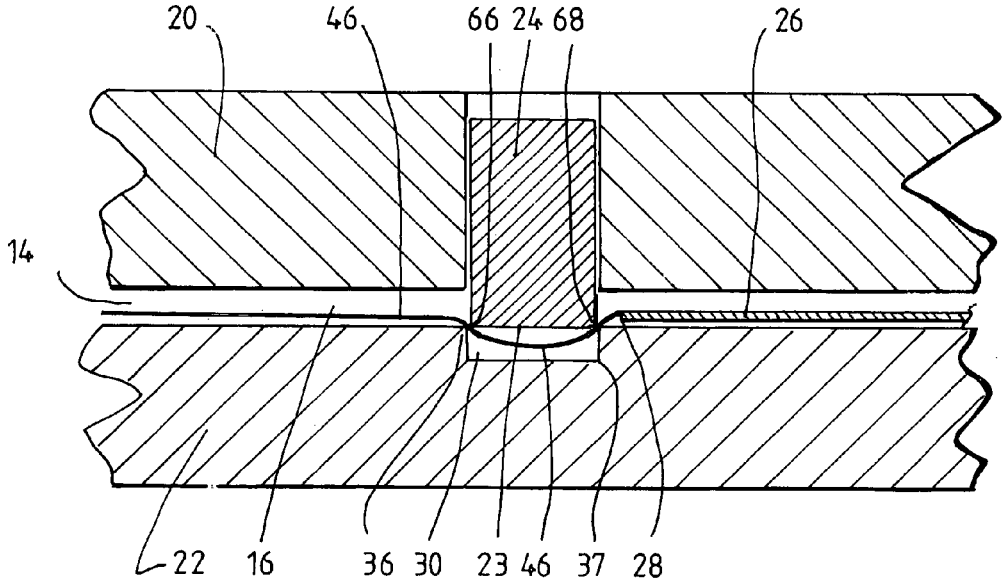
FIG. 2 is a view similar to that of FIG. 1, with the gate means prevented from moving into the fully closed position by the presence of a string.

As best shown in FIGS. 1 and 2, when a note 26 is inserted in the insertion slot 14 and moved along by the rollers, there is control means (not shown) provided for opening the gate 24 in response to the presence of the note 26. The note 26 is moved past the gate 24 and when the rear edge 28 of the note 26 is detected as having passed the leading edge 23, the gate 24 is closed or allowed to close. The note 26 is then validated and if it is valid, the note 26 proceeds to a storage location (not shown). If the note 26 is found to be invalid, the gate 24 is opened and the rollers are reversed, returning the rejected note 26 out through the insertion slot 14.

When the gate 24 is in the fully closed position, as shown in FIGS. 4 and 6, the leading edge 23 extends outside the note path 16 and is received within a recess 30 in the lower housing 22. This overlap prevents anything, including the note 26, from sliding along the note path 16 underneath the fully closed gate 24. There is also provided recesses 32, 34 in the sides of upper and lower housings 20, 22. The periphery of the gate 24 is received within the side recesses 32, 34 and the lower recess 30 protecting the gate 24 against being forced open.

When in the fully closed position, projections 38, 40 at the top of the gate 24 contact sensing means, in the form of electrical contacts or pads 42, 44 in the upper housing 20. The contact with the pads 42, 44 closes an electrical circuit, whereby the gate 24 is detected to be in the fully closed position.

If a string 46 was attached to a note 26, as shown in FIG. 2, for the gate 24 to return to the fully closed position, the string 46 would have to follow the tortuous path underneath the gate 24, into the corners of the lower recess 30. As the gate 24 moves down, the string 46 is forced around corners 36, 37 of recess 30 and around corners 66, 68 of gate 24. This places this section of the string 46 in tension, and further movement of the string 46 is prevented. For the string 46 to be forced lower into the lower recess 30 the frictional forces acting against the string 46 at the corners 36, 38, 66, 68 must be overcome so that more of the string 46 is pulled around one or both corners 36, 38. A light spring is used to bias the gate 24 into the fully closed position. The light spring and the weight of the gate 24 does not apply enough downward force to overcome the frictional forces and the bending moment on the string 46. The string 46 therefore prevents the gate 24 from returning to the fully closed position.

If the string 46 is preventing the gate 24 from returning to the fully closed position, the electrical circuit is not closed. If, within a prescribed time, the electrical circuit is not closed, then the absence of a gate closed indication from the pads 42, 44 indicates to the control means the probable existence of an object preventing the gate 24 fully closing. When an object in the note path 16 is indicated in this way, the control means responds by opening the gate 24, returning the note 26 and string 46 out the insertion slot 14.

The effect of the recess 30 is to amplify the distance of the projections 38, 40 from the pads 42, 44 caused by the presence of the string 46. Without the recess 30, the gap would be equal to or less than the diameter of the string 46, which is undesirably sensitive to manufacturing tolerances.

The movement of the gate 24 is controlled by an actuator 50, such as a solenoid. A right angled drive mechanism 52 is provided, which includes a plate 54 connected to the end of the armature 56 of the solenoid 50. The plate 54 includes a pair of parallel pin slots 58, 60, which engage pins 62, 64 projecting from the gate 24. The slots 58, 60 are angled or oblique, with the gate 24 being biased towards the closed position, as shown in FIG. 6, by light helical compression spring 48 about armature 56. When the gate 24 is required to be opened, the rod 56 is drawn in, overcoming the spring 48. This 4 moves the plate 54 to the left, forcing the pins 62, 64 up the angled slots 58, 60, which raises the gate 24. When the gate 24 is to be closed, the solenoid is deactivated, and the spring 48 forces the rod 56 to extend, pushing the plate 54 to the right. The pins 62, 64 drop down the angled slots 58, 60, closing the gate 24. This mechanism allows linear movement of plate 54 in the horizontal direction, which produces a smooth and even movement of the gate 24 in the vertical direction. Such a mechanism enables fine tolerances to be used to achieve a smooth movement of the gate 24. An advantage of the right angled drive mechanism 52 is that it allows the actuator 50 to be in a different dimension to the movement of the gate 24, where more room is available.

Slots 58, 60 have non-oblique parallel end-portions 59 to lock or at least latch the gate 24 in its fully closed and fully open positions.

Figure 7:
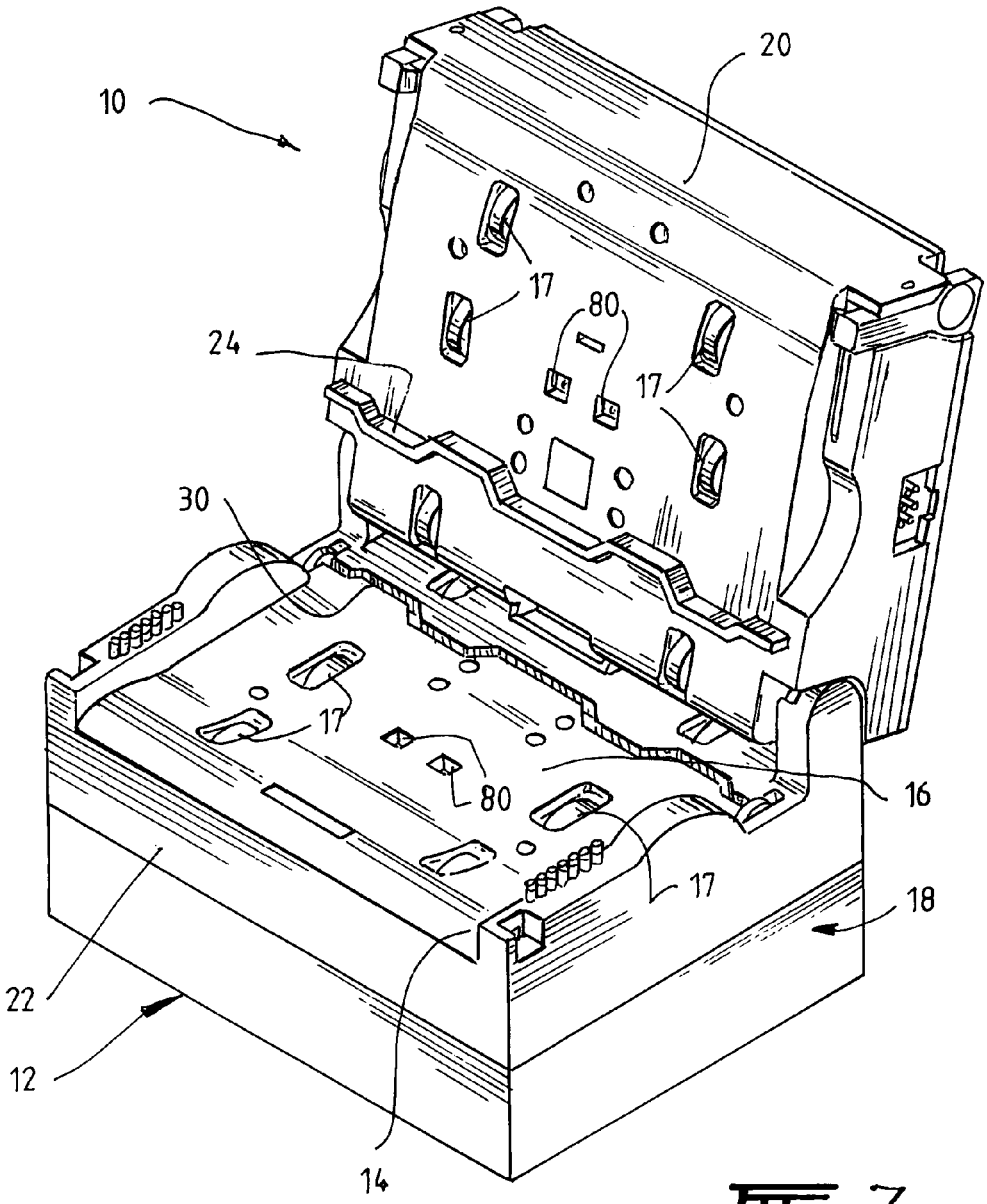
FIG. 7 is an isometric view of the foreign object detector and housing according to another embodiment of the invention.
Figure 8:
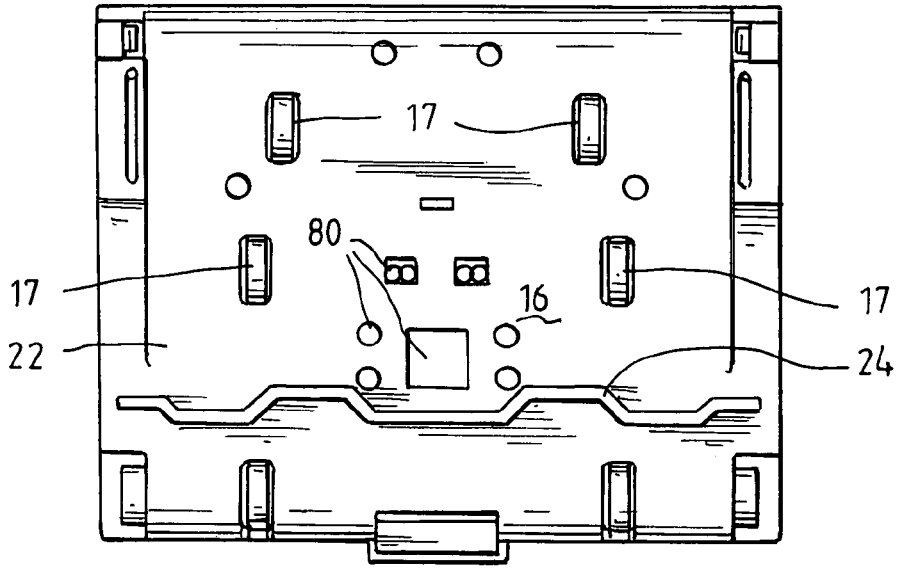
FIG. 8 is a bottom view of the upper housing of the foreign object detector of FIG. 7.
Figure 9:
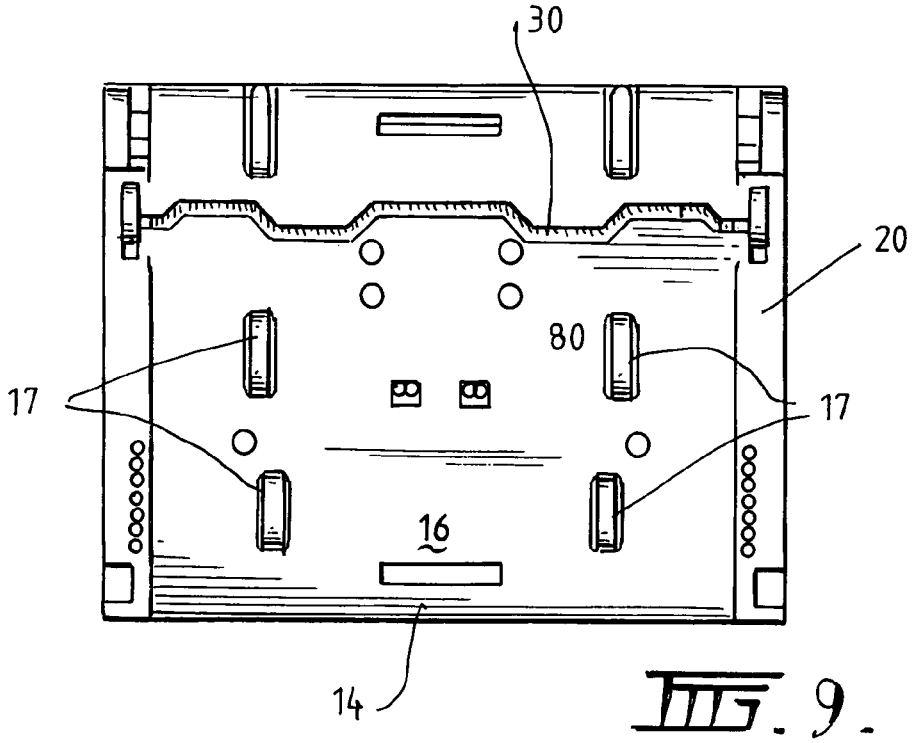
FIG. 9 is a top view of the lower housing of the foreign object detector of FIG. 7.

As can be seen in the embodiment shown in FIGS. 7, 8 and 9, the gate 24 and recess 30 have a matching zig-zag profile when viewed from above. This construction additionally guards against the risk of the note being caught by an edge of the recess 30. By having the recess with a matching zig-zag profile, the notes are less likely to get caught than on a straight edge. The views of FIGS. 7, 8 and 9 also reveal the windows or ports 80 for the optical elements that form part of the validation componentry.

The foreign object detector of the present invention provides advantages over the prior art, as it does not permanently capture the string, so that the note and its string can be easily rejected, without interfering with the note and without disabling the note validator. The detector is also not sensitive to ambient light conditions.

It will be understood that the invention disclosed and defined in this specification extends to all alternative combinations of two or more of the individual features mentioned or evident from the text or drawings. All of these different combinations constitute various alternative aspects of the invention.

I claim:

1. A foreign object detector for a note validator, the detector including:

structure defining a note path;

an insertion slot at one end of the note path and a drive mechanism for moving a note along the note path;

a gate in the note path operable between an open position for allowing the note to pass the gate and a fully closed position for preventing a note from passing the gate, wherein the gate is biased towards the fully closed position; and a spaced sensing device, the sensing device including a first sensor positioned on a first side of the note path and a second sensor positioned on a second side of the note path, the sensing device co-operable with the gate so that only when the gate is in the fully closed position and physical contact is made is a gate closed indication provided;

wherein, in the fully closed position, a leading edge of the gate extends outside the note path and is received within a channel in the structure defining the note path, wherein a string or tape in the note path obstructing the channel prevents the gate from reaching the fully closed position, the spaced sensing device thereby detecting the presence of the string or tape in the note path by the absence of a gate closed indication;

and wherein, the foreign object detector further includes a control device that responds to the absence of the gate closed indication from the spaced sensing device by opening the gate and reversing movement of the drive mechanism to move the note and the string or tape out through the insertion slot.

2. A foreign object detector according to claim 1, wherein the control device is arranged to open the gate, drive the note past the gate and then drive or allow the gate to move towards its fully closed position, whereby to detect any string or tape attached to the rear edge of the note.

3. A foreign object detector according to claim 2, wherein the rear edge of the note is detected to trigger the closing of the gate.

4. A foreign object detector according to claim 1, wherein the note path is generally rectangular and defined by a housing.

5. A foreign object detector according to claim 1, wherein the note path is generally rectangular and defined by a housing.

6. A foreign object detector according to claim 2, wherein the note path is generally rectangular and defined by a housing.

7. A foreign object detector according to claim 4, wherein the gate travels from one side of the note path to the opposite side.

8. A foreign object detector according to claim 5, wherein the gate travels from one side of the note path to the opposite side.

9. A foreign object detector according to claim 6, wherein the gate travels from one side of the note path to the opposite side.

10. A foreign object detector according to claim 1, wherein the gate is biased towards the fully closed position by a light spring.

11. A foreign object detector according to claim 3, wherein the gate is biased towards the fully closed position by a light spring.

12. A foreign object detector according to claim 7, wherein the gate is biased towards the fully closed position by a light spring.

13. A foreign object detector according to claim 1, wherein the first and second sensing device includes contacts for the gate that close an electrical circuit to signal that the gate is in the fully closed position.

14. A foreign object detector according to claim 1, wherein the gate is associated with an actuator, such as a solenoid, for moving the gate at least from the fully closed position to the open position.

15. A foreign object detector according to claim 10, wherein the gate is associated with an actuator, such as a solenoid, for moving the gate at least from the fully closed position to the open position.

16. A foreign object detector according to claim 10, wherein the gate is connected to the actuator via a right angle drive mechanism.

17. A foreign object detector according to claim 16, wherein the right angle drive mechanism includes a pair of parallel oblique pin slots, which are engaged by respective pins projecting from the gate.

18. A foreign object detector according to claim 17, wherein the slots have parallel portions to lock or latch the gate in the fully closed and/or fully open positions.

19. A foreign object detector according to claim 1, wherein, when viewed from above, the gate has a zig-zag profile.

20. A foreign object detector according to claim 2, wherein, when viewed from above, the gate has a zig-zag profile.

21. A foreign object detector according to claim 4, wherein, when viewed from above, the gate has a zig-zag profile.

22. A foreign object detector according to claim 7, wherein, when viewed from above, the gate has a zig-zag profile.

23. A foreign object detector for a note validator, the detector including:

structure defining a note path;

an insertion slot at one end of the note path and a drive mechanism for moving the note along the note path;

a gate in the note path operable between an open position for allowing a note to pass the gate and a fully closed position for preventing a note from passing the gate, wherein the gate is biased towards the fully closed position;

a spaced sensing device including first and second sensors positioned on different sides of the note path co-operable with the gate so that only when the gate is in the fully closed position is a gate closed indication provided; and control means that responds to the absence of a gate closed indication from the spaced sensing device as an indication that there is a string or tape in the note path; by opening the gate and reversing movement of the drive mechanism to move the note and the string or tape out through the insertion slot.

24. A foreign object detector according to claim 23, wherein the control means is arranged to open the gate, drive the note past the gate and then drive or allow the gate to move towards its fully closed position, whereby the foreign object detector detects any string or tape attached to the rear edge of the note.

25. A foreign object detector according to claim 24, wherein the rear edge of the note is detected to trigger the closing of the gate.

26. A foreign object detector according to claim 23, wherein the gate is biased towards the fully closed position by a light spring.

27. A foreign object detector according to claim 23, wherein the first and second sensors comprise contacts for the gate that close an electrical circuit to signal that the gate is in the fully closed position.

28. A foreign object detector according to claim 23, wherein the gate is associated with an actuator, such as a solenoid, for moving the gate at least from the fully closed position to the open position.

29. A foreign object detector according to claim 28, wherein the gate is connected to the actuator via a right angle drive mechanism.

30. A foreign object detector according to claim 29, wherein the right angle drive mechanism includes a pair of parallel oblique pin slots, which are engaged by respective pins projecting from the gate.

31. A foreign object detector according to claim 30, wherein the slots have parallel portions to lock or latch the gate in the fully closed and/or fully open positions.

32. A foreign object detector according to claim 13 wherein the gate has respective projections that engage the respective contacts.

33. A foreign object detector according to claim 27 wherein the gate has respective projections that engage the respective contacts.

34. A foreign object detector according to claim 1 wherein the first sensor and the second sensor are at different ends of the gate.

35. A foreign object detector according to claim 23 wherein the first sensor and the second sensor are at different ends of the gate.

36. A foreign object detector according to claim 13 wherein the spaced sensing means are at respective ends of the gate.

37. A foreign object detector according to claim 27 wherein the spaced sensing means are at respective ends of the gate.

38. A foreign object detector according to claim 1, wherein said physical contact is made between the gate and the spaced sensing device.

39. A foreign object detector according to claim 23, wherein physical contact is made between the gate and the first and second sensing means in the fully closed position to generate the gate closed indication.

40. A foreign object detector for a note validator, the detector comprising:

structure defining a note path;

an insertion slot at one end of the note path and a drive mechanism for moving the note along the note path;

a gate in the note path operable between an open position for allowing a note to pass the gate and a fully closed position for preventing a note from passing the gate, wherein the gate is biased towards the fully closed position; and a spaced sensing device, the sensing device including a first electrical contact positioned at a first side of the gate and a second electrical contact positioned at a second side of the gate, the spaced sensing device being physically contacted by the gate when the gate is in the fully closed position, thereby closing an electrical circuit and generating a gate closed indication;

wherein, in the fully closed position, a leading edge of the gate extends outside the note path and is received within a channel in the structure defining the note path, wherein a string or tape in the note path obstructing the channel prevents the gate from reaching the fully closed position, the spaced sensing means thereby detecting the presence of the string or tape in the note path by the absence of a gate closed indication;

and wherein the foreign object detector further includes control means that responds to the absence of a gate closed indication from the spaced sensing device by opening the gate and reversing movement of the drive mechanism to move the note and the string or tape out through the insertion slot.

41. A method implemented in a foreign object detector for a note validator for determining a presence of a foreign object in the foreign object detector, the foreign object detector including structure defining a note path, a gate in the note path operable between an open position for allowing a note to pass the gate and a fully closed position for preventing a note from passing the gate, the method comprising:

on the foreign object detector, receiving a note in an insertion slot at one end of the note path;

detecting the presence of the note in the note path and opening the gate in response to the detected note;

moving the note past the gate along the note path by a drive means;

detecting a rear edge of the note passing a leading edge of the gate;

closing the gate, wherein the leading edge of the gate extends outside the note path in the fully closed position and is received within a channel in the structure defining the note path;

determining the presence of string or tape in the note path by the absence of a gate closed indication, the gate closed indication provided by a spaced sensing device, the spaced sensing device including a first electrical contact positioned at a first side of the gate and a second electrical contact positioned at a second side of the gate, wherein when the first and second electrical contacts are physically contacted by the gate, an electrical circuit is completed and the gate closed indication is generated; and upon determining the presence of string or tape in the note path, returning the note and the string or tape to the insertion slot by opening the gate and reversing movement of the drive means.

* * * * *